United States Patent [19]

James, III

[11] Patent Number: 4,571,790

[45] Date of Patent: Feb. 25, 1986

[54] CASKET WITH ATTACHABLE CORNERS

[75] Inventor: Jasper T. James, III, Sumter, S.C.

[73] Assignee: Sumter Casket Company, Sumter, S.C.

[21] Appl. No.: 526,985

[22] Filed: Aug. 29, 1983

[51] Int. Cl.[4] ..... A61G 17/00
[52] U.S. Cl. ..... 27/10
[58] Field of Search ..... 27/2, 5, 6, 7, 10, 19, 27/1; 52/288, 287, 278

[56] References Cited

U.S. PATENT DOCUMENTS

| | | | |
|---|---|---|---|
| 2,213,506 | 9/1940 | Thoresen | 27/10 |
| 2,264,243 | 11/1941 | Knuth | 52/288 |
| 2,450,091 | 9/1948 | Kendall | 27/10 |
| 3,025,624 | 3/1962 | Harrell | 27/10 |
| 3,491,820 | 1/1970 | Ostling | 52/811 |
| 3,828,499 | 8/1974 | Leddy | 52/278 |

*Primary Examiner*—Robert A. Hafer
*Assistant Examiner*—Daniel Nolan
*Attorney, Agent, or Firm*—Thomas & Kennedy

[57] ABSTRACT

A casket 10 has decorative right angle corner plates 18 detachably mounted thereto by mounting means that includes shoulder screws 22 and retaining clips 34.

6 Claims, 4 Drawing Figures

10
11
15
14
13
12
16
16
18

36
36
34
37
40
39
37
34
37
41

13
32
12
25
26
22
24
37
36
35
45
30
37
36
40
39
38
34
35
21
19
20
18

CASKET WITH ATTACHABLE CORNERS

TECHNICAL FIELD

This invention relates to caskets of the type embellished with symbols or emblems.

BACKGROUND OF THE INVENTION

Caskets are often embellished with religious symbols or other emblems that are associated with the deceased to be buried therein. Funeral homes often maintain a supply of caskets having, for example, Christian, Jewish or Masonic symbols formed on their exteriors. Typically, the emblems are carved into the casket material, or into a panel that is rigidly and permanently attached to the exterior surface of the casket. Since caskets require substantial storage space, funeral directors have found it difficult and expensive to store adequate supplies of caskets in an efficient manner since it is, of course, not possible to anticipate the demand for caskets that include particular symbols or emblems over particular time spans. It would, therefore, lead to efficiency were caskets to be developed with attachable, decorative plates or the like so that a standard casket could be adorned with appropriate symbols to suit the family of the deceased. If such were to be developed then a relatively small number of caskets of standard design could be stored in funeral homes and various decorative plates could be secured thereto as demand dictated. Accordingly, the present invention is directed to the provision of a casket of the type having attachable, decorative plates.

SUMMARY OF THE INVENTION

A generally rectangular casket has upright walls joined together to form wall corners having exterior surfaces, and decorative corner plates are positioned about the exterior surface of each corner. Each decorative corner plate comprises two panels joined together at their edges in approximately a right angle and the corner plate is sized and shaped to fit snugly about a corner of the casket and be detachably mounted thereto by mounting means. The mounting means includes a shoulder screw that is screwed into and extends from the inner surface of one of the corner plate panels. The shoulder screw includes a threaded shank formed with a head and a shoulder protrusion displaced from the head. The mounting means also includes a mounting bracket or clip mounted to one of the corner walls of the casket. The clip includes an aperture of a size to receive the head of the shoulder screw and a slot extends away from the aperture along which the shank of the shoulder screw can be slid and the head captured thereby.

DETAILED DESCRIPTION

Figures 1, 2, 3, 4:
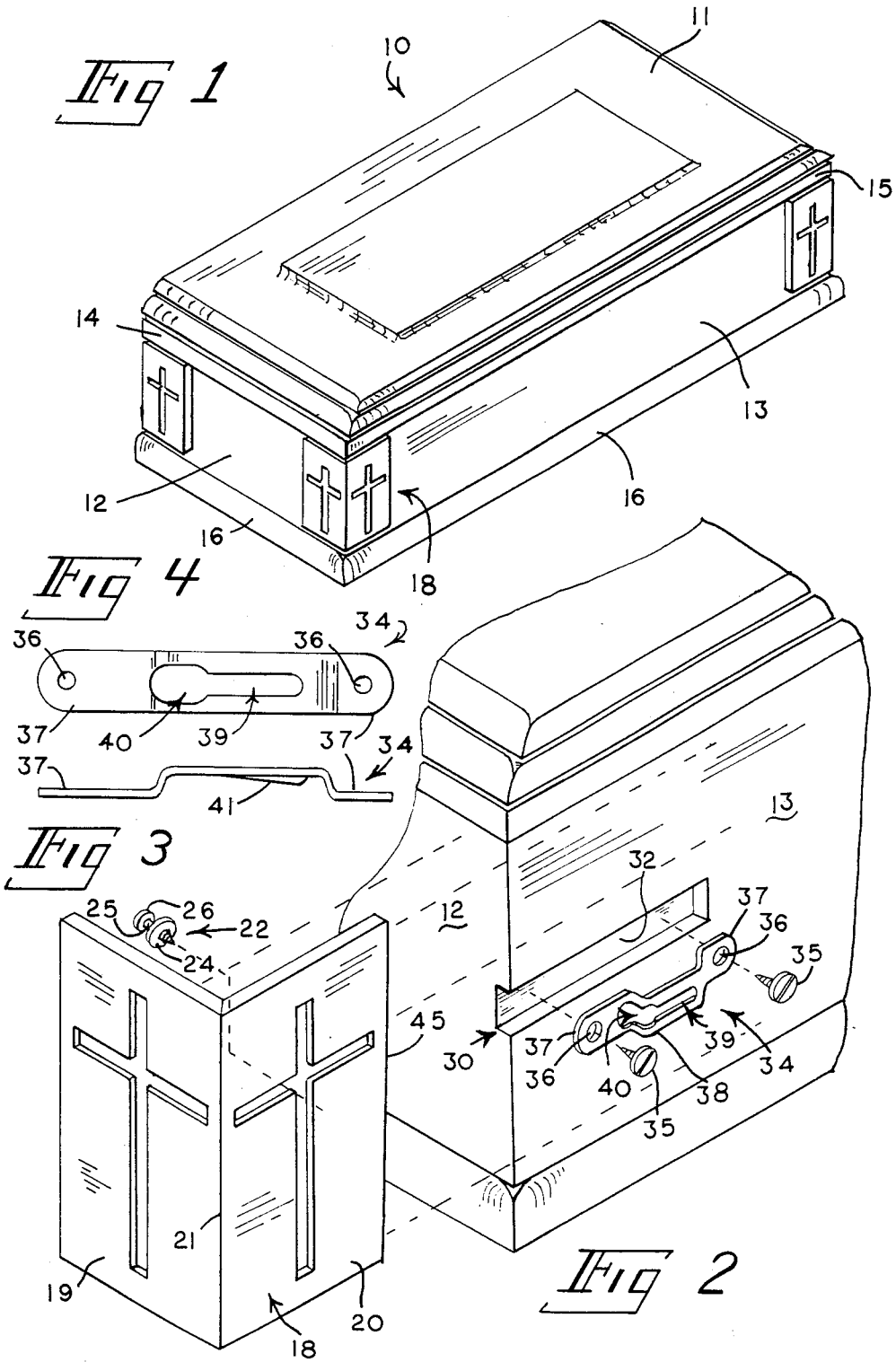
FIG. 1 is a perspective view of a casket embodying principles of the present invention.
FIG. 2 is an exploded view of a corner of the casket illustrated in FIG. 1.
FIG. 3 is a side elevational view of a mounting bracket or clip of the casket shown in FIGS. 1 and 2.
FIG. 4 is a plan view of the mounting bracket or clip illustrated in FIG. 3.

Referring now in more detail to the drawing, in which like parts are illustrated by like numerals, FIG. 1 illustrates a casket 10 having a top 11 and two opposite vertical end walls 12 and two opposite vertical side walls 13 that are joined together at right angles. The end walls 12 have upper strips of molding 14 while the side walls 13 have upper strips of molding 15 that join moldings 14. Base molding strips 16 are provided about the casket parallel with the upper strips of mouldings. The casket also has decorative corner plates 18 at each of four corners that are embellished with a symbol, such as a Christian cross, on each of two flat, angularly joined panels of the plates.

With reference next to FIG. 2, each of the decorative corner plates 18 is seen to have two panels 19 and 20 joined together at a right angle to form an edge 21. A shoulder screw 22 is threaded into a rear face of the panel 20 until the screw shoulder 24 is flush against the rear surface of the panel. Once mounted in this manner a screw shank 25 projects outwardly from the rear surface of the panel and the screw shoulder to an enlarged head 26.

As illustrated in FIG. 2, the casket side wall 13 is seen to be formed with a groove 30 which is open-ended in the end wall 12. To the floor 32 of the groove is mounted a mounting bracket or clip 34 by means of two screws 35 that are passed through holes 36 in coplanar feet or flanges 37 of the mounting bracket and into the groove floor 32. The mounting bracket includes a raised, central portion 38 spanning the two feet or flanges 37, and the central portion is formed with a slot 39 that extends from an enlarged, aperture aperture 40. The aperture 40 is of a size sufficient to receive the head 26 of the shoulder screw 22 while the width of the elongated slot is sufficient to slidably acccommodate the screw shank 25 therein but insufficient to permit the head 26 to extend straight therethrough. Thus the screw head 26 may be passed through the aperture 40 and captured by that portion of the mounting bracket surrounding the slot 39. Since, as best seen in FIG. 3, the bottom portion of the mounting bracket about the sides of the slot is tapered at 41, the mounting bracket will wedge the screw as it is slid in the slot in the direction extending away from aperture 40. An example of this type of clip or mounting bracket is described in more detail in U.S. Pat. No. 3,491,820.

To mount the decorative corner plate 18 to the casket 10 the mounting bracket 34 is screwed in place within the confines of the groove 30 and the shoulder screw is screwed into place through the inner surface of panel 19 or 20 of the corner plate, and the corner plate is positioned as shown in FIG. 2 and then moved towards the casket so as to bring the shoulder screw head 26 in through the aperture 40 of the mounting bracket and behind the slot 39 with the screw shank 25 extending through the slot. Continued movement of the corner plate towards the casket, with corner panel 19 approaching flush engagement with wall 12, brings the screw head 26 onto the tapered surface 41 of the clip. This causes the panel 20 of the corner plate to be wedged closer to the casket wall 13. Movement of the corner plate 18 is continued until the inner surface of the corner plate panel 19 is brought flush against the casket wall 12. At the same time panel 20 is brought flush against wall 13. In this manner corner plates may be detachably mounted to the four casket corners in a very secure manner between the casket moldings 14, 15 and 16. So mounted, the corner plates appear to be a permanent part of the casket itself. However, each can be easily dismounted by urging the panel edge 45 to the left, as viewed in FIG. 2, thereby forcing the shoulder screw head 26 to slide behind the slot 39 and out through aperture 40 thereby detaching the corner plate from the casket.

The abutment of the inner surface of panel 19 against the end wall 12 of the casket stabilizes the corner plate, tending to hold the corner plate in position and avoiding any tilting or twisting of the corner plate after it has been attached to the casket.

It should be understood that the just-described embodiment of the invention merely illustrates principles of the invention in one preferred form. Many modifications, additions and deletions may, of course, be made thereto without departure from the spirit and scope of the invention as set forth of the following claims.

I claim:

1. A casket having at least two walls joined together to form a wall corner having flat exterior surfaces extending at right angles with respect to each other; a decorative corner plate having panels joined at their edges and each with a flat surface extending at a right angle with respect to the flat surface of the other for abutment with the exterior surfaces at a wall corner of said casket; and mounting means for attaching one of the panels of said decorative corner plate to said wall corner with the flat surfaces of said panels flush against both of the right angle surfaces of said wall corner, said mounting means comprising a recessed groove formed in one of the surfaces of said wall corner or of said panels and a retaining clip rigidly mounted in said groove, said retaining clip including an aperture and a slot of width less than the width of the aperture that extends from the aperture, and a shoulder screw means rigidly mounted to the other of the surfaces of said wall corner or of said panel, said should screw including an enlarged head of a size less than said aperture width but greater than said slot width, the head of said shoulder screw and the slot of said retaining clip being shaped so that when the head of the shoulder screw is inserted into the aperture and is slid along the slot to slide the flat surface of said one panel along said one right angle flat surface of said wall corner the flat surface of said one panel is drawn toward the facing flat surface of the wall corner and the flat surface of the other panel is moved in flush abutment with the other right angle flat surface of said wall corner so that the other right angle flat surface of the other panel tends to hold the corner plate in an upright attitude on the casket so that the corner plate does not tend to tilt with respect to the casket.

2. The casket of claim 1 wherein said recessed groove extends from the corner edge of the wall corner along the wall, and wherein said clip is mounted to the floor of said groove, and said wall corner when mounted on the casket covers the recessed groove.

3. A casket having at least two walls joined at adjacent edges to form a corner having exterior surfaces oriented at an angle; a decorative corner plate having two panels joined at their adjacent edges at an angle corresponding to the angle of the corner of said casket and having surfaces shaped to fit snugly about said corner; a projection extending from one of said corner plate panels having a shank with a head on the shank end spaced from said panel, and a clip mounted to one of said corner walls of said casket having an aperture of a size to receive said projection head therethrough from which aperture a slot extends away from said corner edge along which said projection shank may be slid with said projection head captured thereby to slide said one corner plate panel adjacent said one corner wall and to bring the other corner plate panel into abutment with the other corner wall, the slot of said clip being sized and shaped to draw the surface of said one corner plate panel toward said one corner wall as the other corner plate panel moves into abutment with the other corner wall so that said one corner plate panel is wedged against said one corner wall and the other corner plate panel abuts the other corner wall and tends to hold the corner plate in an upright attitude on the casket.

4. The casket of claim 3 wherein said one corner wall is formed with a groove extending from said corner edge, and wherein said clip is mounted within said groove.

5. The casket of claim 3 wherein said projection is a shoulder screw.

6. A casket including opposed vertical end walls joined to opposed vertical side walls forming right angle corners, a slot formed in one of the walls at each corner and each slot extending horizontally from its corner along its wall, a clip mounted in each slot, each clip including an aperture and a slot of smaller width than the aperture intersecting the aperture, a right angle corner plate mounted about each right angle corner of said casket, each right angle corner plate comprising a pair of panels, each panel joined at an edge to the other at a right angle, and forming surfaces that fit snugly about a right angle corner and cover the slot in the verticle side wall at the right angle corner, a shoulder screw member fastened to one of said panels and including a head of a size to pass through the aperture of said clip and to be retained by the slot of said clip, the slot of said clip being shaped to draw the panel that covers the slot toward the wall in which the slot is formed as the shoulder screw moves from the aperature along the slot, whereby the corner plate is mounted to the casket by passing the head of the shoulder screw into the aperture and along the slot of the clip and sliding said one panel adjacent the sidewall in which the slot is formed until said one panel of the corner plate is in wedged relationship with the sidewall and the other panel of the corner plate abuts the casket.

* * * * *